United States Patent [19]

Yanagi et al.

[11] 4,444,135

[45] Apr. 24, 1984

[54] PROGRAMMING DEVICE FOR AN AUTOMATIC SEWING MACHINE

[75] Inventors: Toshiaki Yanagi; Yoshinori Bessho, both of Nagoya, Japan

[73] Assignee: Brother Kogyo Kabushiki Kaisha, Nagoya, Japan

[21] Appl. No.: 407,801

[22] Filed: Aug. 13, 1982

[30] Foreign Application Priority Data

Sep. 3, 1981 [JP] Japan ..... 56-139378
Sep. 3, 1981 [JP] Japan ..... 56-139379

[51] Int. Cl.[3] ..... D05B 21/00
[52] U.S. Cl. ..... 112/121.12
[58] Field of Search ..... 112/121.12, 158 E, 121.11, 112/102, 103

[56] References Cited

U.S. PATENT DOCUMENTS

| | | | |
|---|---|---|---|
| 3,416,056 | 12/1968 | Motooka et al. | 112/121.12 X |
| 4,266,493 | 5/1981 | Hanyu et al. | 112/158 E |
| 4,385,570 | 5/1983 | Yanagi | 112/121.12 |
| 4,388,883 | 6/1983 | Hirota et al. | 112/121.12 |

*Primary Examiner*—Peter P. Nerbun
*Attorney, Agent, or Firm*—Browdy & Neimark

[57] ABSTRACT

A programming device for an automatic sewing machine wherein a succession of stitches are formed along a desired stitching line registered via a stitch pattern record medium according to a batch of sewing instructions. The programming device comprises: stitch pitch setting means for setting a pitch of the stitches formed along the stitching line; means for sequentially reading coordinate positions spaced along the stitching line at an interval longer than the pitch set by the pitch setting means; first memory means for storing the coordinate position data read by the reading means; control means for sequentially reading out the stored coordinate position data such that the data of three consecutive coordinate positions are always available, and preparing a series of sewing instructions to form the stitches which are located on a circular arc passing the three consecutive positions defined by the read-out coordinate position data and which are equally spaced at the preset pitch; and second memory means for storing the prepared sewing instructions. The programming device preferably further comprises a spacing interval selector for setting an interval at which at least one additional succession of stitches are formed in parallel to the desired stitching line. In this specific form, the control means prepares at least one additional group of coordinate position data according to which are prepared sewing instructions for said additional succession of stitches.

7 Claims, 16 Drawing Figures

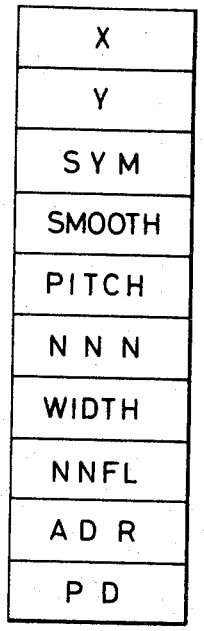
FIG. 11
FIG. 12
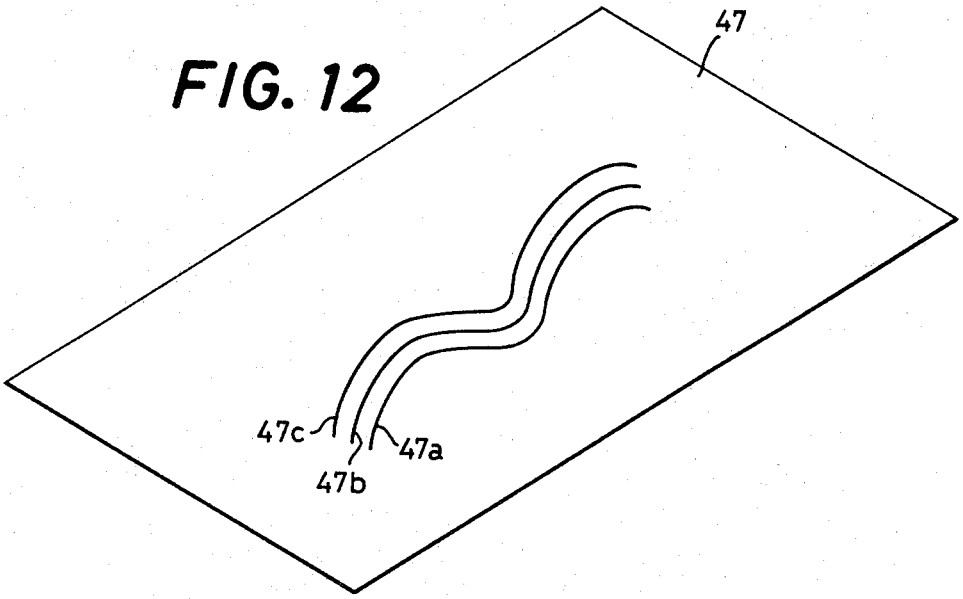

PROGRAMMING DEVICE FOR AN AUTOMATIC SEWING MACHINE

BACKGROUND OF THE INVENTION

This invention relates to a programming device or system for an electronically-controlled sewing machine capable of automatic formation of a succession of stitches from prepared sewing instructions.

In the art of a programming system for use on electronically-controlled sewing machines for industrial applications for sewing multiple stitch patterns in spaced and parallel relation with one another, it is required to program in sequence positions of all stitches of those patterns and store the programmed sewing instructions in the programming system one after another. In such programming system, however, a lot of time and labor are required to prepare the sewing instructions by reading each of the stitch positions, particularly when the desired patterns to be formed consists of a multiplicity of stitches. Another shortcoming encountered in the art is the requirement for exact tracing of stitch patterns along their curvatures to read precisely the stitch positions so as to assure neat formation of the curved stitch pattern or seamline. Thus, the conventional programming procedure for preparing sewing instructions is extremely time-consuming and troublesome.

SUMMARY OF THE INVENTION

Accordingly, it is an object of the invention to provide a programming device for an automatic sewing machine, which overcomes the conventional shortcomings stated above and permits easy preparation of stitch instructions to form a stitch pattern having a smooth curvature.

It is another object of the invention to provide a programming device for an automatic sewing machine, which enables the sewing machine to readily form a plurality of smoothly curved stitch patterns in spaced and parallel relation with one another.

According to the present invention, there is provided a programming device for an automatic sewing machine wherein a succession of stitches are formed by relative movements between a needle and a work holder according to a batch of sewing instructions corresponding to a desired profile registered via a pattern record medium, characterized in that the programming device comprises:

stitch pitch setting means for setting a pitch of the stitches;

reading means for sequentially reading coordinate positions spaced along the profile at an interval longer than the pitch set by the setting means;

first memory means for storing coordinate data of the coordinate positions read by the reading means;

first control means for sequentially reading out the coordinate data from the first memory means such that the coordinate data of three consecutive ones of the coordinate positions are always available;

second control means for preparing a series of sewing instructions to form the stitches which are located on a circular arc passing the three consecutive coordinate positions defined by the coordinate data thereof and equally spaced at the pitch set by the setting means; and second memory means for storing the sewing instructions prepared by the second control means.

According to another form of the invention, the programming device further comprises interval setting means for setting an interval of spacing at least one additional line of stitch pattern which is disposed in parallel to the original line of stitch pattern formed along said profile, and said first and second control means are adapted to prepare at least one additional group of coordinate position data corresponding to said at least one additional line of stitch pattern, store the additional group of coordinate data in the first memory means, and prepare the sewing instructions to form the additional line in the same manner.

These and other objects and features of the invention will become more apparent from the following description of preferred embodiment thereof taken in connection with the accompanying drawings.

BRIEF DESCRIPTION OF THE DRAWINGS

The present invention is illustrated in the accompanying drawings in which:

FIG. 11 is a view showing memory areas of a working memory connected to the control circuit;

FIG. 12 is a perspective view of a pattern record sheet on which a desired stitch pattern is registered.

DETAILED DESCRIPTION OF THE PREFERRED EMBODIMENT

Referring now to the accompanying drawings, there will be described the present invention embodied on a sewing machine.

Figure 1A:
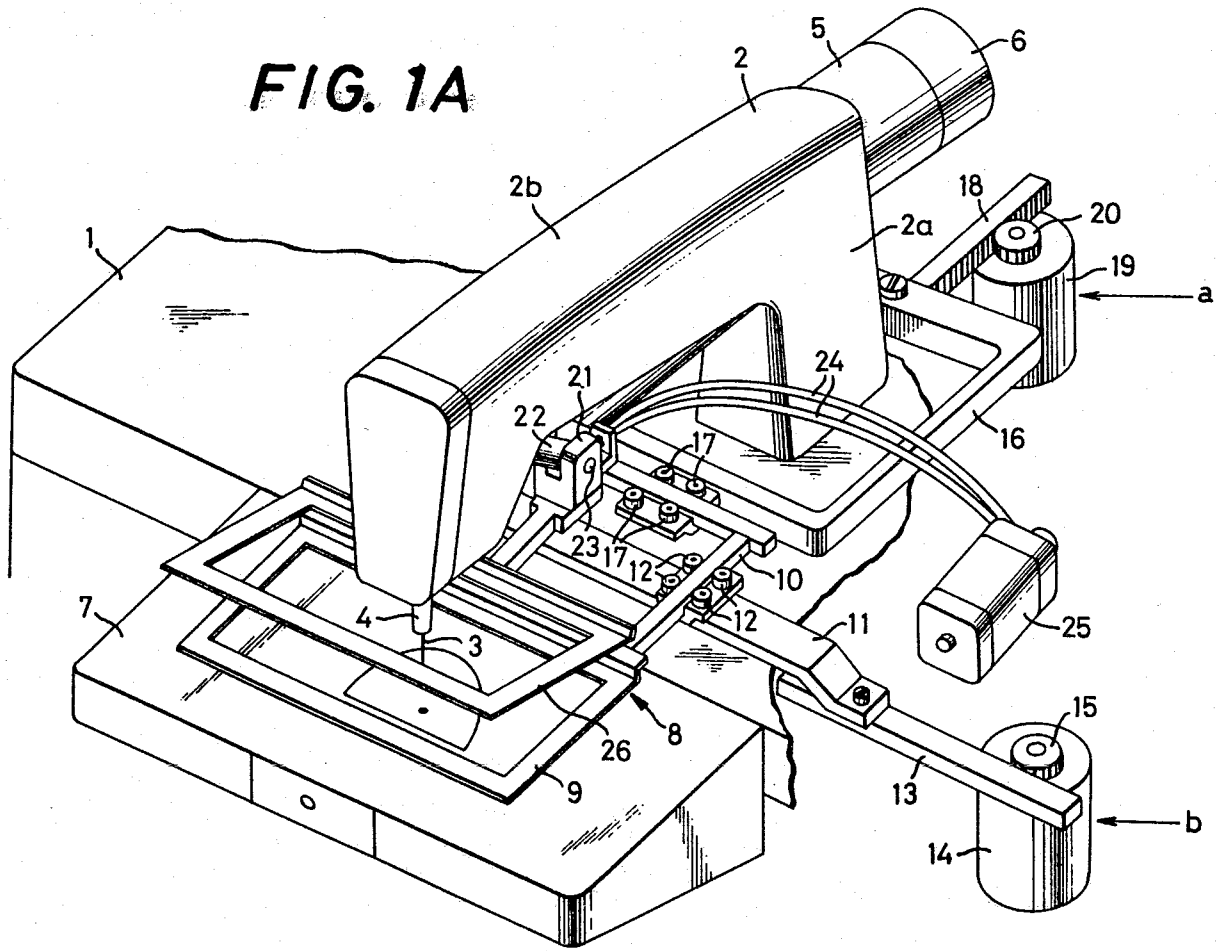
FIG. 1A is a fragmentary perspective view of a sewing machine on which the present invention is embodied.

There is shown in FIG. 1A a table 1 of the sewing machine on which is mounted a machine frame 2 which has a standard **2*a* and a bracket arm 2*b* extending toward the front of the machine. The bracket art 2*b* includes a head portion which is provided with a vertically movable needle bar 4 having at its lower end a needle 3. The head portion is further provided with a vertically movable presser bar (not shown) having at its lower end a presser foot (not shown). There is mounted on the rear side of the bracket arm 2*b* a direct current (DC) drive motor 5 which provides vertical movements of the needle bar 4. Attached to the rear side of the DC drive motor 5 is a needle position detector 6 which detects an angular position, i.e., rotation of a drive shaft of the DC drive motor 5 and generates a detection signal each time the needle 3** is located at a predetermined position, e.g., lowered or lifted position.

There is provided, at the central front of the table 1, a workpiece support bed 7 on which is supported a work holder 8 which is movable in a horizontal plane across the reciprocating path of the needle 3. The needle 3 and a shuttle hook (not shown) incorporated in the workpiece support bed 7 cooperate to form stitches on a workpiece held by the work holder 8.

The work holder 8 comprises a work supporting frame 9 disposed on the workpiece support bed 7. The work supporting frame 9 is fixed at the rear to a feed frame 10 which is supported movably in both lateral (X)

and cross (Y) directions, i.e., along the X and Y axes of the machine.

The feed frame 10 is operatively coupled to a connecting member 11 which is supported movably only in the lateral direction and which carries guide rollers 12 engaging two opposite sides of the feed frame 10. The guide rollers 12 permits the feed frame 10 to move in the cross direction. The connecting member 11 is connected, at its right-hand side end as viewed in FIG. 1A, to a rack 13 which engages a pinion 15 fixed to a drive shaft of an X-axis pulse or stepper motor 14, whereby the feed frame 10 is moved, via the rack 13 and the connecting member 11, to the left as viewed in FIG. 1A, i.e., in the positive X (+X) direction when the stepper motor 14 is operated in one direction, and to the right, i.e., in the negative X (−X) direction when it is operated in the other or reverse direction.

The feed frame 10 is operatively coupled further to a connecting frame 16 which is supported movably only in the cross (Y) direction and which carries guide rollers 17 engaging the rear side of the feed frame 10. The guide rollers 17 permit the feed frame 10 to move in the lateral (Y) direction. The connecting frame 16 is connected, at its rear side, to a rack 18 which engages a pinion 20 fixed to a drive shaft of a Y-axis pulse or stepper motor 19, whereby the feed frame 10 is moved, via the rack 18 and the connecting frame 16, toward the rear, i.e., in the negative Y (−Y) direction when the stepper motor 19 is operated in one direction, and toward the front, i.e., in the positive Y (+Y) direction when it is operated in the other direction. With this construction, the forward and reverse rotation of the X-axis and Y-axis stepper motors 14 and 19 will cause the work supporting frame 9 to move in the lateral and cross directions thereby allowing any point within the supporting frame 9 to be brought into alignment with the needle 3 or located at a needle lowering position (hereinafter simply called "needle position") in the horizontal plane.

There is fixed to the feed frame 10 a block 21 which has a pivot arm 22 connected thereto pivotally about a support pin 23. The base or supported end portion of the pivot arm 22 is coupled to a drive motor 25 through two wires 24 so that the pivot arm 22 is pivoted via the wires 24 in upward and downward directions upon rotation of the drive motor 25 in opposite directions. To the free or distal end portion of the pivot arm 22, is operatively connected a presser frame 26 which has the same configuration and size as the work supporting frame 9. The presser frame 26 cooperates with the work supporting frame 9 to retain the workpiece therebetween when the pivot arm 22 is pivoted downwardly.

There is described next an electric circuit of a programming device of the invention provided on the above sewing machine.

Figure 1B:
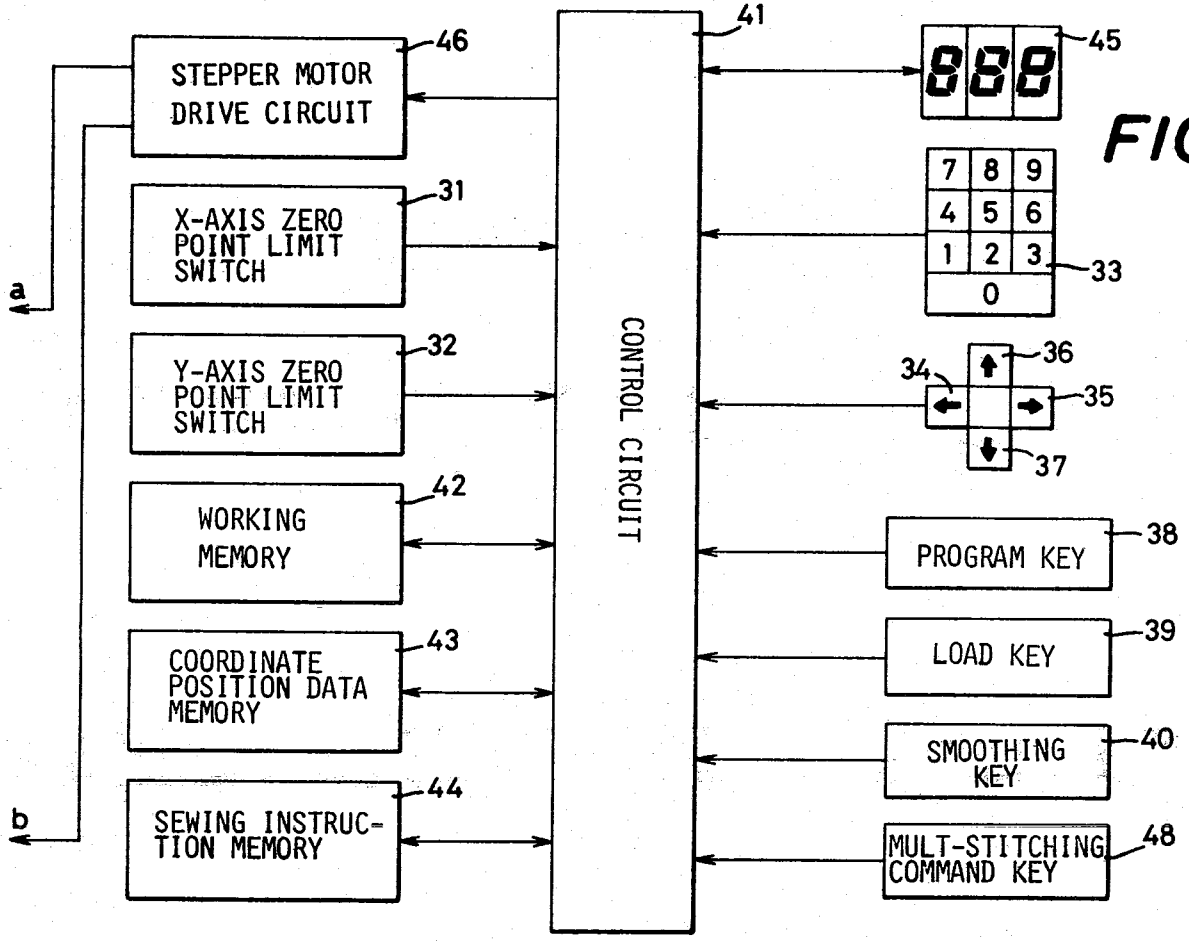
FIG. 1B is a block schematic diagram of a control circuit associated with one embodiment of a programming device of the invention.

In FIG. 1B, there is shown an X-axis zero point limit switch 31 which is disposed in the proximity of a reciprocating motion path of the previously described rack 13. The limit switch 31 generates an ON signal upon engagement of its movable actuator piece with the rack 13 when the inner edge of the left-hand side of the work supporting frame 9 (as viewed in FIG. 1A) is located at the needle position as a result of a rightward movement of the rack 13 by the X-axis stepper motor 14. Similarly, a Y-axis zero point limit switch 32 is disposed in the proximity of a reciprocating motion path of the previously described rack 18. The limit switch 32 generates an ON signal upon engagement of its movable actuator piece with the rack 18 when the inner edge of the rear side of the work supporting frame 9 is located at the needle position as a result of a forward movement of the rack 18 by the Y-axis stepper motor 19. Numeric keys 33; [0] through [9] are disposed on a program control console (not shown) provided on the sewing machine. These keys 33 are automatically resettable and used to serve as means for setting a desired pitch of stitches forming a unit stitch pattern, a desired number of additional stitch patterns disposed parallel to the unit stitch pattern, and a desired distance of spacing of those multiple stitch patterns. When the numeric keys 33 are pressed, corresponding code signals are produced.

There are also provided, on the program control console, X- and Y-axis jog keys 34, 35, 36 and 37 which are automatically resettable and produce, when pressed, pulse signals to move the work holder 8 in corresponding directions. More specifically, pressing one of the X-axis jog keys 34 will cause the work holder 8 to move to the left as seen in FIG. 1A. On the other hand, pressing the other X-axis jog key 35 will cause the same holder 8 to move to the right. Similarly, the holder 8 is moved toward the rear when one of the Y-axis jog keys 36 is pressed, while it is moved toward the front when the other Y-axis jog key 37 is pressed.

The program control console further provides a program key 38 which is also automatically resettable and is used to start programming a curved stitch pattern or preparing sewing instructions to form such pattern. When the key 38 is pressed, an ON signal is generated. There is also provided on the program control console an automatically resettable load key 39 which, when pressed, produces an ON signal that causes a later described coordinate position data memory 43 to store coordinate position data of stitching points Q1*a* through Qn*a* which coordinate position data are established by manipulating the X- and Y-axis jog keys 34 through 37. The load key 39 and the jog keys 34–37 are major elements constituting coordinate position data reading means.

A smoothing key 40 provided on the program control console is also automatically resettable and used when programming, for example, a curved unit stitch pattern 47*a* registered on a pattern record medium such as a pattern record sheet 47 shown in FIG. 12. In more detail, the smoothing key 40 is used to prepare sewing instructions to form the curved unit stitch pattern 47*a* shown in FIG. 13, based on coordinate position data of stitching points Q1*a* (first stitch position) through Qn*a* (last stitch position) which are spaced along the line of the stitch pattern at a selected interval longer than a stitch pitch preset by the appropriate numeric keys 33. The coordinate positions of the points Q1*a*–Qn*a* are read and used to prepare the sewing instructions so that the spaced stitching points Q1*a*–Qn*a* are connected by substantially circular arcs, that is, each portion of the stitch pattern between adjacent ones of the points Q1*a*–Qn*a* is substantially defined by a circular arc. The ON signal generated upon actuation of this smoothing key 40 is fed to the control circuit 41.

A multi-stitching command key 48 which is also provided on the program control console and automatically resettable, is used when preparing sewing instructions for additional stitch patterns 47*b* and 47*c* which are disposed parallel to the unit stitch pattern 47*a*, based on the first group of coordinate position data associated with the stitching points Q1*a* through Qn*a* of the stitch pattern 47*a*. An ON signal produced by this key 48 upon actuation thereof is received by the control circuit 41.

The control circuit 41 designed as first and second control means receives the ON signals and code signals from the respective limit switches and keys 31 through 40, and are adapted to control the following operations according to those signals: reading of coordinate positions of the above indicated stitching points Q1*a*–Qn*a* by moving the work holder 8 carrying the record sheet 47 shown in FIG. 12; preparation of sewing instructions for each stitch based on the obtained coordinate position data such that the stitching points Q1*a*–Qn*a* are connected by substantially circular arcs; preparation of coordinate position data of stitching points Q1*b*–Qn*b* nd Q1*c*–Qn*c* of the curved stitch patterns 47*b* and 47*c*, respectively, and of sewing instructions for those patterns 47*b* and 47*c*, based on the coordinate position data of the stitching points Q1*a*–Qn*a* and on a distance of spacing of the patterns 47*a*, 47*b* and 47*c* preset by the numeric keys 33; and operation of the sewing machine according to the prepared sewing instructions.

The working memory 42 is a random access memory which has the following data storage or memory areas as indicated in FIG. 11: an area in which is stored data X representative of the number of steps of the X-axis stepper motor 14 obtained during an operation thereof by manipulating the X-axis jog keys 34 and 35 (a distance of lateral movement of the work holder 8); an area in which is stored data Y representative of the number of steps of the Y-axis stepper motor 19 obtained during an operation thereof by manipulating the Y-axis jog keys 36 and 37 (a distance of cross movement of the work holder 8); an area in which is stored data SYM representative of rotating directions of the X- and Y-axis stepper motors 14 and 19 (positive or negative direction in which the work holder 8 is moved along the X and Y axes); an area in which is stored data SMOOTH representative of whether the smoothing key 40 has been actuated or not; an area in which is stored data PITCH representative of a stitch pitch preset by the numeric keys 33; an area in which is stored data NNN representative of the number of additional stitch patterns disposed parallel to the unit stitch pattern, which number is preset by the numeric keys 33; an area in which is stored data WIDTH representative of a distance of spacing of all stitch patterns (47*a*, 47*b* and 47*c*); an area in which is stored data NNFL representative of whether the multi-stitching key 48 has been actuated or not; an area in which is stored data ADR representative of an address of an coordinate position data memory 43 described later; and an area in which are temporally stored data PD which are obtained based on the first group of coordinate position data associated with the unit stitch pattern.

The coordinate position data memory 43 is a random access memory which sequentially stores, at its respective memory areas, the first group of coordinate position data of the stitching points Q1*a*–Qn*a*, or another group of the same data associated with the stitching points Q1*b*–Qn*b* or Q1*c*–Qn*c*.

There is also provided a sewing instruction memory 44 which is also a random access memory which stores at its respective addresses sewing instructions for each of the stitches to form the multiple curved stitch patterns 47*a*, 47*b* and 47*c*. The sewing instruction for each stitch include the data representing the number of steps of the X- and Y-axis stepper motors 14 and 19, and the data representing the rotating directions.

An indicator device 45 includes a seven-segment, three-digit display which indicates numerical values corresponding to the numeric keys 33 that are actuated.

A stepper motor drive circuit 46 drives the X- and Y-axis stepper motors 14 and 19 a selected number of steps in a selected direction in response to drive control signals supplied from the control circuit 41.

Referring to FIGS. 2 through 10 which are flow charts associated with the control circuit 41, the operation of the sewing machine constructed as previously disclosed will be described.

Figure 2:
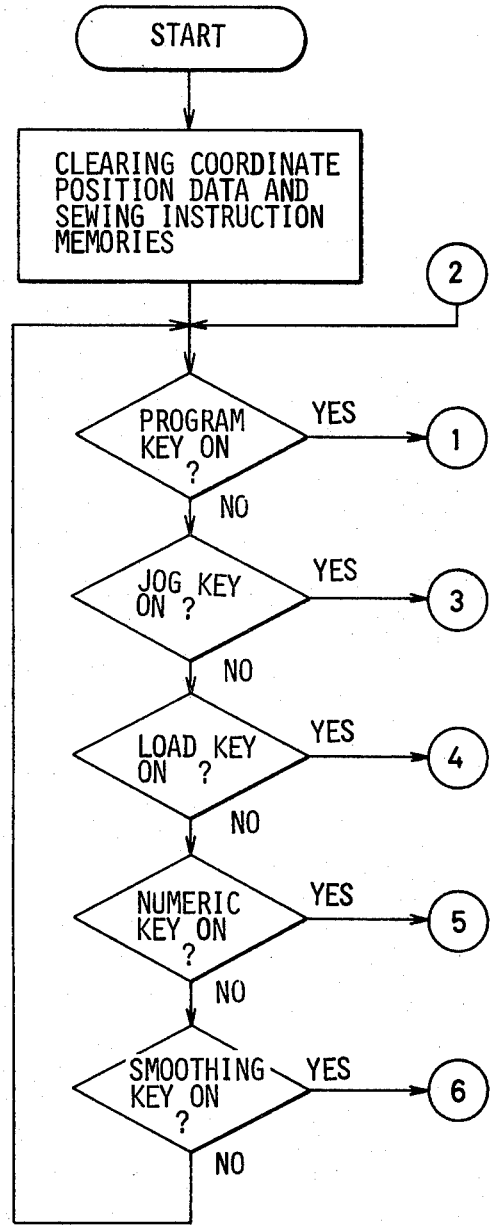
FIGS. 2–10 are flow charts illustrating arithmetic and processing operations of the control circuit.
Figure 3:
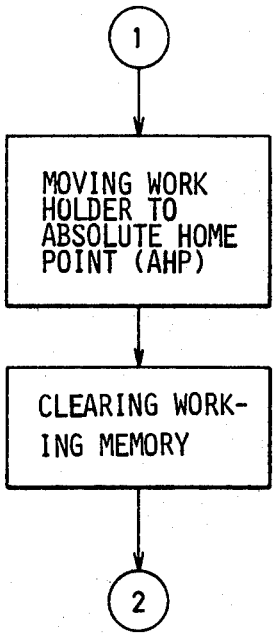

When a power on-off switch (not shown) of the sewing machine is turned on, the control circuit 41 will operate in the sequence as shown in the flow chart of FIG. 2. Upon power application to the machine, the coordinate position data memory 43 and the sewing instruction memory 44 are cleared and the control circuit 41 becomes ready to receive the outputs of the various control keys 33 through 44, and 48, i.e., the circuit 41 will wait for operation of those keys for programming the curved unit stitch pattern 47*a* on the pattern record sheet 47 or preparing sewing instructions to form that curvature stitch pattern. To program the stitch pattern 47*a*, the machine operator first holds the pattern record sheet 47 on the work holder 9 and then turns on the program key 38. As soon as the program key 38 is turned on, the control circuit 41 produces the drive control signals, which are received by the stepper motor drive circuit 45 to operate the X- and Y-axis stepper motors 14 and 19 such that the work holder 8 is moved to the absolute zero or home position AHP (such that the left rear corner of the work supporting frame 9 is located at the needle position), as indicated in the flow chart of FIG. 3. When the work holder 8 has reached the absolute home position AHP, the X- and Y-axis limit switches 31 and 32 are both turned on and generate the ON signals which cause the control circuit 41 to produce the drive control signals for stopping the work holder 8, clear the working memory 42, and become ready to accept the subsequent output of the control keys.

Figure 4:
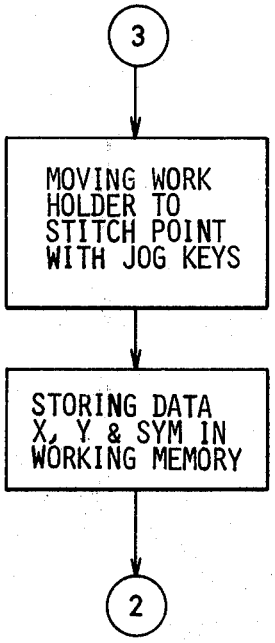

When the appropriate jog keys 34–37 are operated to move the work holder 8 for establishing alignment of the first stitch point Q1*a* on the pattern 47*a* on the record sheet 47 with the needle position, the control circuit 41 will operate in the sequence as shown in the flow chart of FIG. 4, so that the X- and Y-axis stepper motors 14 and 19 are each operated by a required number of steps in the selected direction to align the stitch point Q1*a* with the needle position. The obtained data X and Y (numbers of steps of the motors 14 and 19) and data SYM (rotating directions of the motors) are stored in the respective areas of the working memory 42. Then, the control circuit 41 will wait for operation of the load key 39.

Figure 8A:
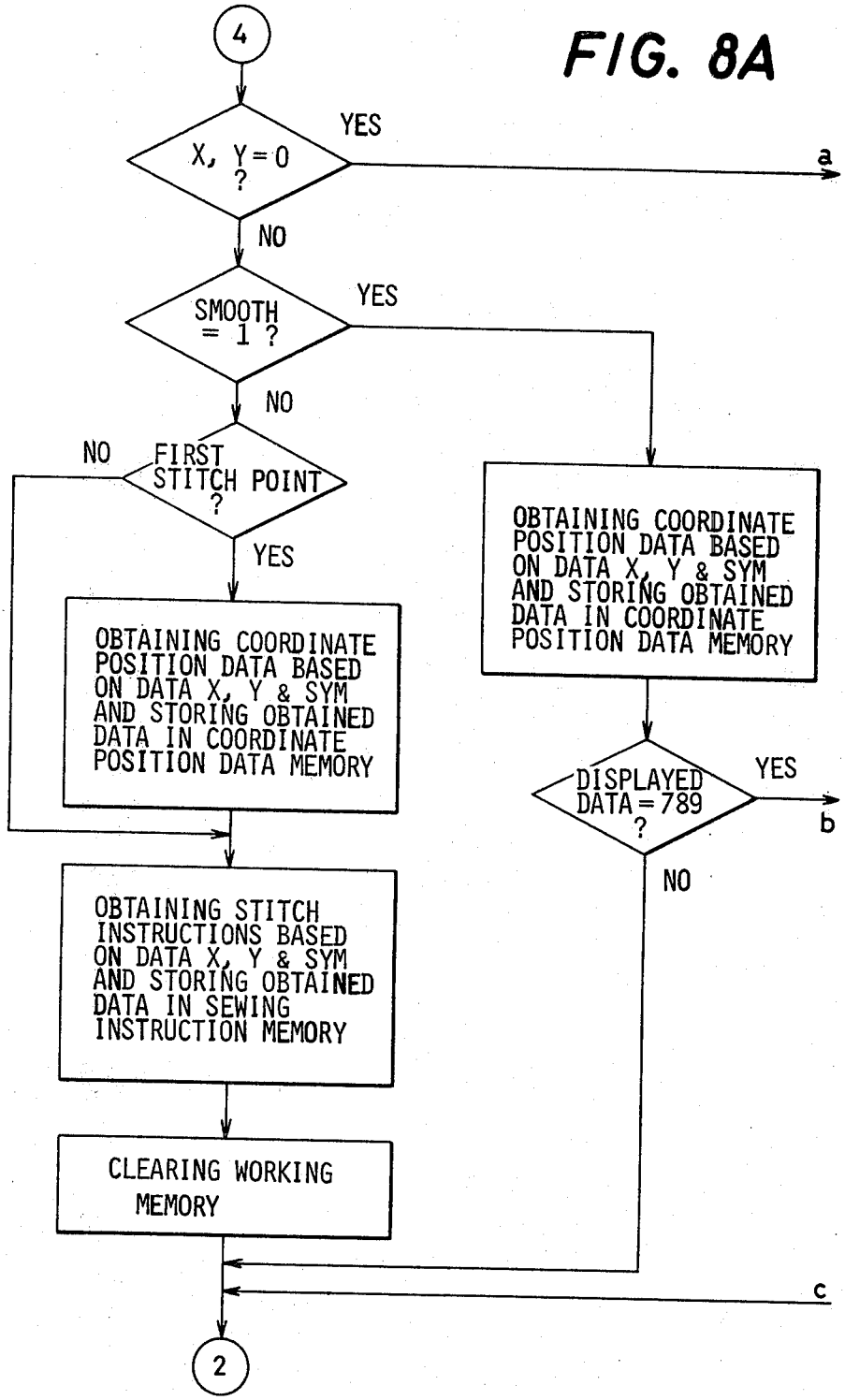
Figure 8B:
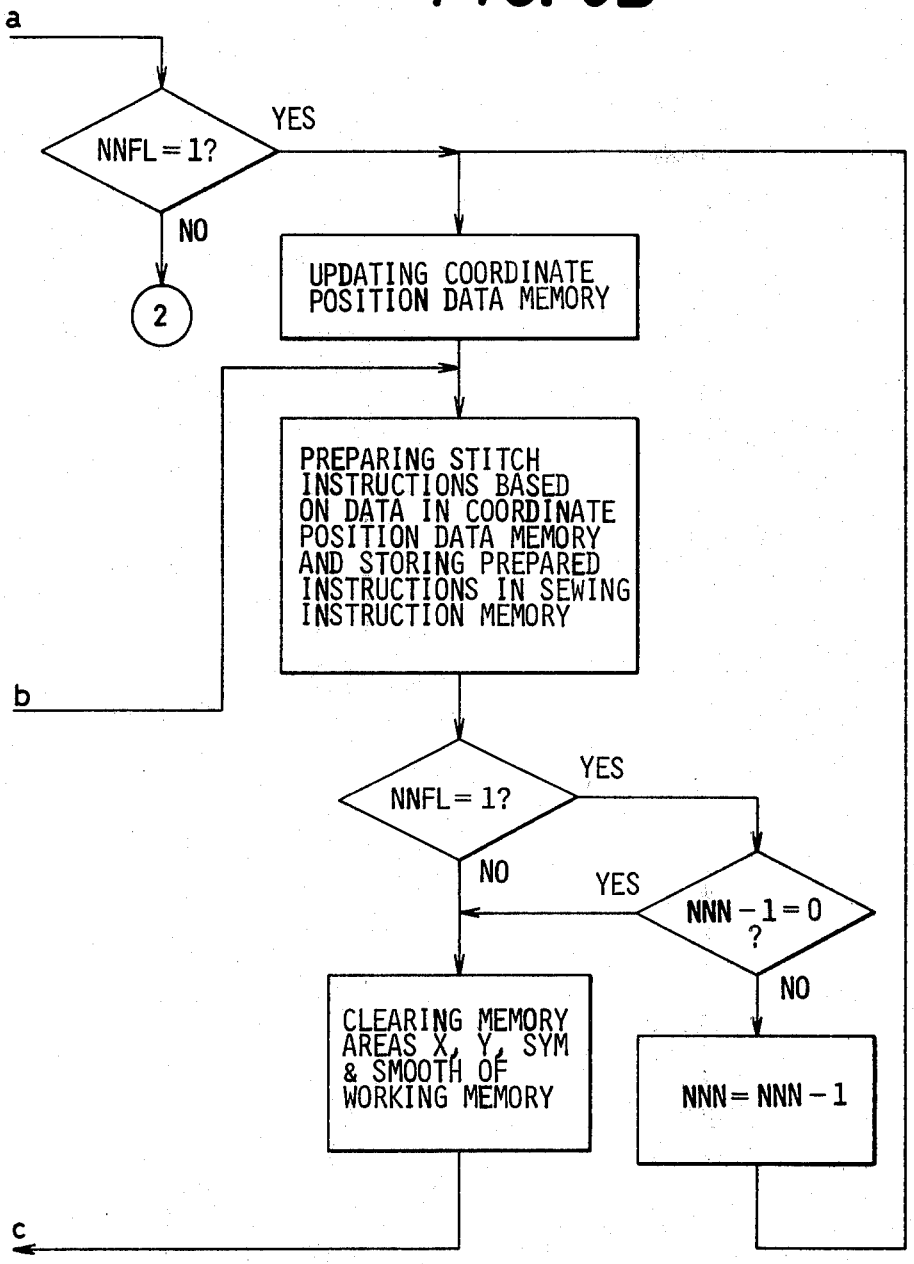

Upon turning on the load key 39, the control circuit 41 will operate in the sequence as shown in the flow chart of FIGS. 8A and 8B. At first, the circuit 41 judges whether the data X and Y representing the numbers of steps of the stepper motors 14 and 19 are stored in the working memory 42 and further judges whether the data SMOOTH in the working memory 42 is "1" or not. Since the data SMOOTH is "0" at this time, the circuit 41 then proceeds to judge whether the data X, Y and SYM now stored in the respective areas of the working memory 42 are associated with the first stitch point Q1*a* or not. Recognizing that the working memory 42 stores those data for the stitch point Q1*a*, the control circuit 41 works out, based on the data X, Y and SYM, coordinate position data of the stitch point Q1*a*, i.e., X-axis coordinate data XQ1*a* and Y-axis coordinate data YQ1*a*, and stores the obtained data XQ1*a* and YQ1*a* at the appropriae addresses of the coordinate position data memory 43. Simultaneously, the control circuit 41 prepares stitch instructions to form the first stitch Q1*a* and stores them at the appropriate address of the sewing instruction memory 44. Then, the circuit 41 waits for operation of the numeric keys 33.

Figure 5:
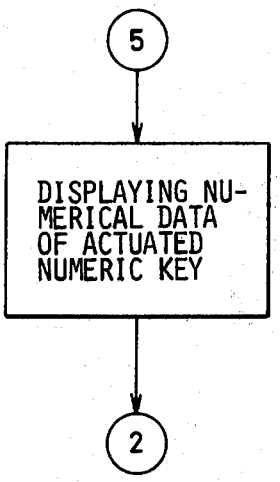

When a stitch pitch of the curved stitch pattern 47*a* is subsequently set by depressing an appropriate one of the numeric keys 33 as indicated in FIG. 2, the control circuit 41 will cause the indicator device 45 to display the numerical data corresponding to the preset stitch pitch, and waits for the next operation of the keys, as shown in FIG. 5.

Figure 6:
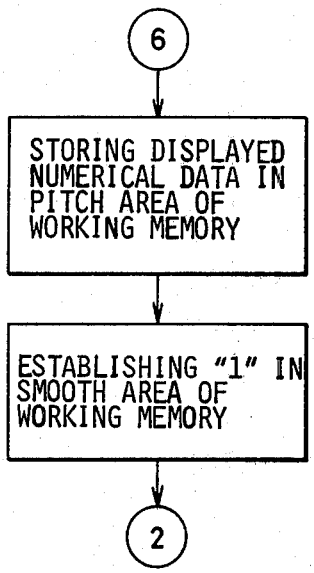

Upon depressing the smoothing key 40, the control circuit 41 stores the stitch pitch data displayed on the indicator 45 into the memory area PITCH of the working memory 42 and establishes the data "1" in the memory area SMOOTH of the same memory, as shown in FIG. 6. Then, the circuit 41 waits for the next operation of the keys.

Successively, a stitching point Q2*a* is selected at a position on the stitch pattern 47*a* on the pattern record sheet 47 so that the point Q2*a* is apart from the first stitch point Q1*a* by a distance longer than the preset stitch pitch. Then, the appropriate jog keys 34–37 are operated to move the work holder 8 until the stitching point Q2*a* is put into alignment with the needle position. At this time, the control circuit 41 will operate, as shown in FIG. 4, the stepper motors 14 and 19 to move the work holder 8 from the stitch point Q1*a* to Q2*a*, and stores the obtained data X, Y and SYM (representing the numbers of steps and rotating directions of the motors) in the respective memory areas of the working memory 42.

When the load key 39 is then depressed, the control circuit 41 first judges whether the data X and Y are stored in the working memory 42 and further judges whether the data SMOOTH in the working memory 42 is "1" or not, as shown in FIGS. 8A and 8B. Since, at this time, the data X and Y of the stitching point Q2*a* are stored in the working memory 42, and the data SMOOTH is "1", the circuit 41 then proceeds to obtain, based on the data X, Y and SYM stored in the respective areas of the working memory 42, coordinate position data of the stitching point Q2*a*, i.e., X-axis coordinate data XQ2*a* and Y-axis coordinate data YQ2*a*. The circuit 41 stores these coordinate position data in the respective addresses of the coordinate position data memory 43 following the addresses at which the coordinate position data of the first stitch point Q1*a* are stored.

In the next step, the control circuit 41 judges whether a display of "789" is provided on the indicator device 45 or not. Since the indicator device is now displaying the numerical data showing the preset stitch pitch, the circuit 41 waits for the next operation of the keys.

Successively, a stitching point Q3*a* is selected in the same manner as previously used to locate the stitching point Q2*a* so that the point Q3*a* is apart from the point Q2*a* by a distance longer than the preset stitch pitch. Then, the appropriate jog keys 34–37 are operated to move the work holder 8 until the stitching point Q3*a* is put into alignment with the needle position. At this time, the data X, Y and SYM representing the total numbers of steps of the stepper motors 14 and 19 obtained during the movement from the point Q1*a* to Q3*a*, and rotating directions thereof, are stored in the respective memory areas of the working memory 42.

Upon depressing the load key 39, the control circuit 41 will similarly obtain, based on the data of the stitching point Q3*a* stored in the working memory 42, coordinate position data of this point Q3*a*, i.e., X-axis coordinate data XQ3*a* and Y-axis coordinate data YQ3*a*, and stores the obtained data XQ3*a* and YQ3*a* at the respective addresses of the coordinate position data memory 43.

In the same manner as described above, the coordinate position data of stitching points Q4*a* through Qn*a* which are spaced on the stitch pattern 47*a* at an interval longer than the preset stitch pitch, are stored sequentially in the coordinate position data memory 43. When the last stitch point Qn*a* on the stitch pattern 47*a* has been located at the needle position, the numeric keys 33 are operated to display the numerical values "789" on the indicator device 45. Upon turning on the load key 39, the circuit 41 stores the coordinate position data of the last stitch point Qn*a* in the coordinate position data memory 43, recognizes the numerical values "789" displayed on the indicator device 45, prepares sewing instructions for all stitches based on the batch of coordinate position data stored in the memory 43, and sequentially stores the prepared sewing instructions in the sewing instruction memory 44, as indicated in FIGS. 8A and 8B.

Figure 9:
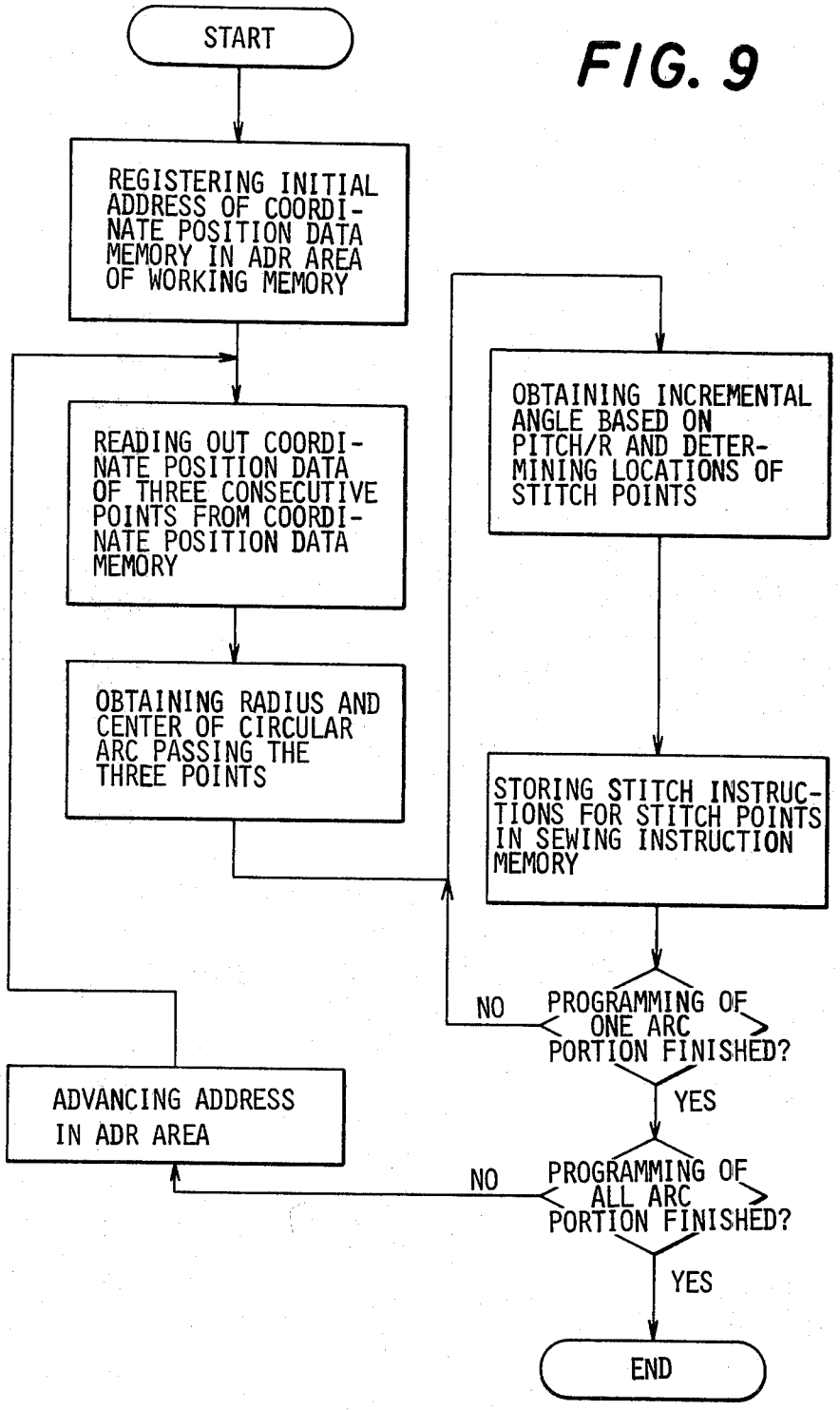
Figure 13:
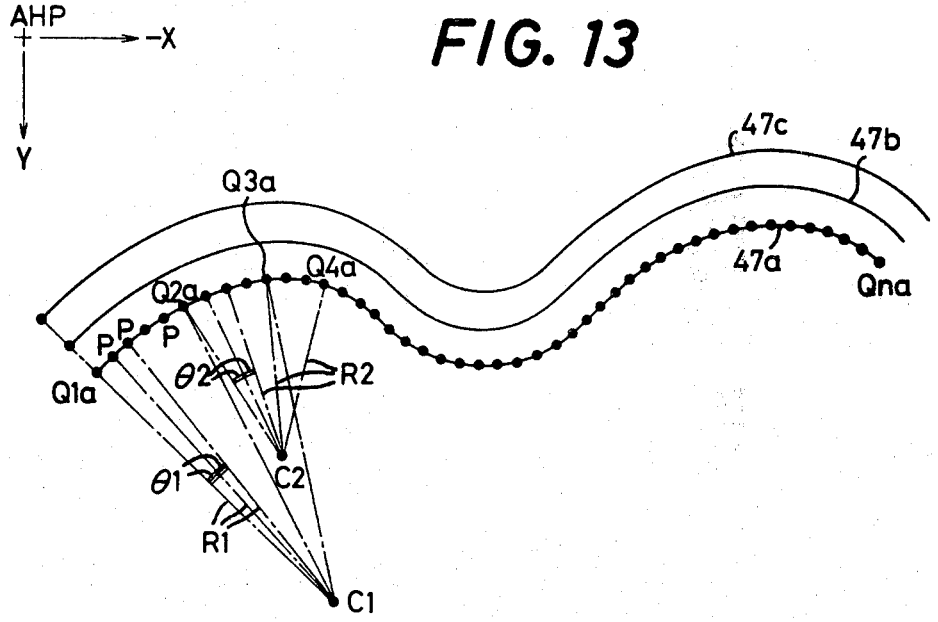
FIGS. 13 and 14 are views showing the stitch patterns to illustrate the features of the invention.

There is described in detail the operation of the control circuit 41 to prepare and store the sewing instructions, with reference to the flow chart of FIG. 9. To begin with, the control circuit 41 registers in the area ADR of the working memory 42 the initial address of the coordinate position data memory 43, that is, the address at which the coordinate position data of the first stitch point Q1*a* is stored. Then, the circuit 41 reads out from the coordinate position data memory 43 the coordinate position data of the first three consecutive stitch points, i.e., Q1*a*, Q2*a* and Q3*a*, based on the address now registered in the working memory 42, and obtains a radius R1 and X and Y coordinates of a center C1 of a circular arc which passes the three points Q1*a*, Q2*a* and Q3*a*, as shown in FIG. 13.

Successively, the control circuit 41 obtains an approximate value of a slight incremental angle $\theta 1$ by dividing the stitch pitch (stored in the area PITCH of the working memory 42) by the radius R1 previously obtained. Then, the Q1*a*–Q2*a* portion of the circular arc passing the points Q1*a*, Q2*a* and Q3*a* is divided to determine the locations of stitch points P in the Q1*a*–Q2*a* portion of the arc such that a central angle of the sector defined by the radii R1 and the Q1*a*–Q2*a* portion is divided by the obtained incremental angle $\theta 1$. Each of the stitch points P is registered in the sewing instruction memory 44 in the form of stitch instructions representing changes in the X and Y coordinates as measured from the preceding point P.

After the stitch instructions for all stitch points P within the Q1*a*–Q2*a* portion have been stored, the control circuit 41 advances the address of the coordinate position data memory 43 registered in the area ADR of the working memory 42, as indicated in FIG. 9. With the address advanced, the circuit 41 reads out the coordinate position data of the three stitching points Q2*a*, Q3*a* and Q4*a*, and obtains a radius R2 and coordinates of a center C2 of a circular arc passing the points Q2, Q3 and Q4.

Similarly, the control circuit 41 obtains an approximate value of a slight incremental angle $\theta 2$ by dividing the stored stitch pitch by the obtained radius R2. Then, the Q2*a*–Q3*a* portion of the circular arc passing the points Q2*a*, Q3*a* and Q4*a* is divided to determine the locations of stitch points P in the Q2*a*–Q3*a* portion of the arc such that a central angle of the sector defined by the radii R2 and the Q2*a*–Q3*a* portion is divided by the obtained incremental angle $\theta 2$. Thus, all stitch points P up to the last stitch point Q*n* spaced on the stitch pattern 47*a* are obtained, and their sewing instructions are stored in the sewing instruction memory 44.

When the stitch instructions for all the stitch points from the first stitch point Q1*a* up to the last stitch point Q*na* on the curved stitch pattern 47*a* have been stored in the sewing instruction memory 44, the control circuit 41 clears the memory areas X, Y, SYM and SMOOTH of the working memory 42 as shown in FIG. 8, and the programming of the stitch pattern 47*a* is completed.

There will be described next the preparation of sewing instructions to form the stitch patterns 47*b* and 47*c* which are additionally disposed in parallel to and along the curvature of the curved stitch pattern 47*a* in a spaced relation with one another at a predetermined interval, as illustrated in FIG. 12.

At first, the appropriate numeric keys 33 are operated first to set the number of the additionally disposed stitch patterns 47*b* and 47*c* (in this instance, the numeric key [2] is pressed) and then to set the desired spacing or interval of the patterns 47*a*, 47*b* and 47*c*. In response to the operation of the numeric keys 33, the control circuit 41 causes the indicator device 45 to display the selected number of additional patterns in its most significant digit, and the selected spacing interval in the second and least significant digits.

Figure 7:
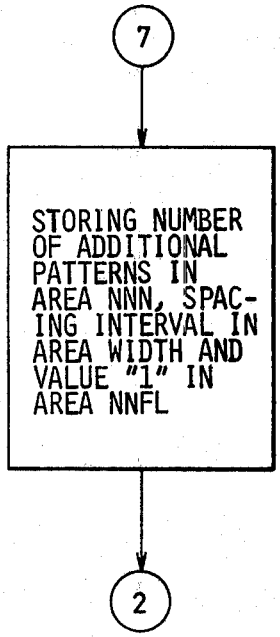

When the multi-stitching command key 48 is then pressed the control circuit 41 stores the number of additional patterns displayed in the most significant digit of the indicator device 45, in the memory area NNN of the working memory 42, and the spacing interval displayed in the following digits, in the memory area WIDTH of the same memory 42, and at the same time establishes the value "1" in the memory area NNFL of the same, as indicated in FIG. 7.

When the load key 39 is pressed in this condition, the control circuit 41 judges, as indicated in FIG. 8, whether any data is stored in the memory area X and Y of the working memory 42 and whether the value "1" is established in the area NNFL of the same. Since, at this time, neither data X nor data Y are stored and the value "1" is present in the area NNFL, the circuit 41 will work out the coordinate position data of the stitching points Q1*b*–Q*nb* of the stitch pattern 47*b* based on the coordinate position data of the stitching points Q1*a*–Q*na* of the pattern 47*a* stored in the coordinate position data memory 43, and stores the obtained position data in the coordinate position data memory 43. Then, the storage of the coordinate position data memory 43 is updated by replacing the position data of the points Q1*a*–Q*na* with those of the points Q1*b*–Q*nb*.

Figure 10:
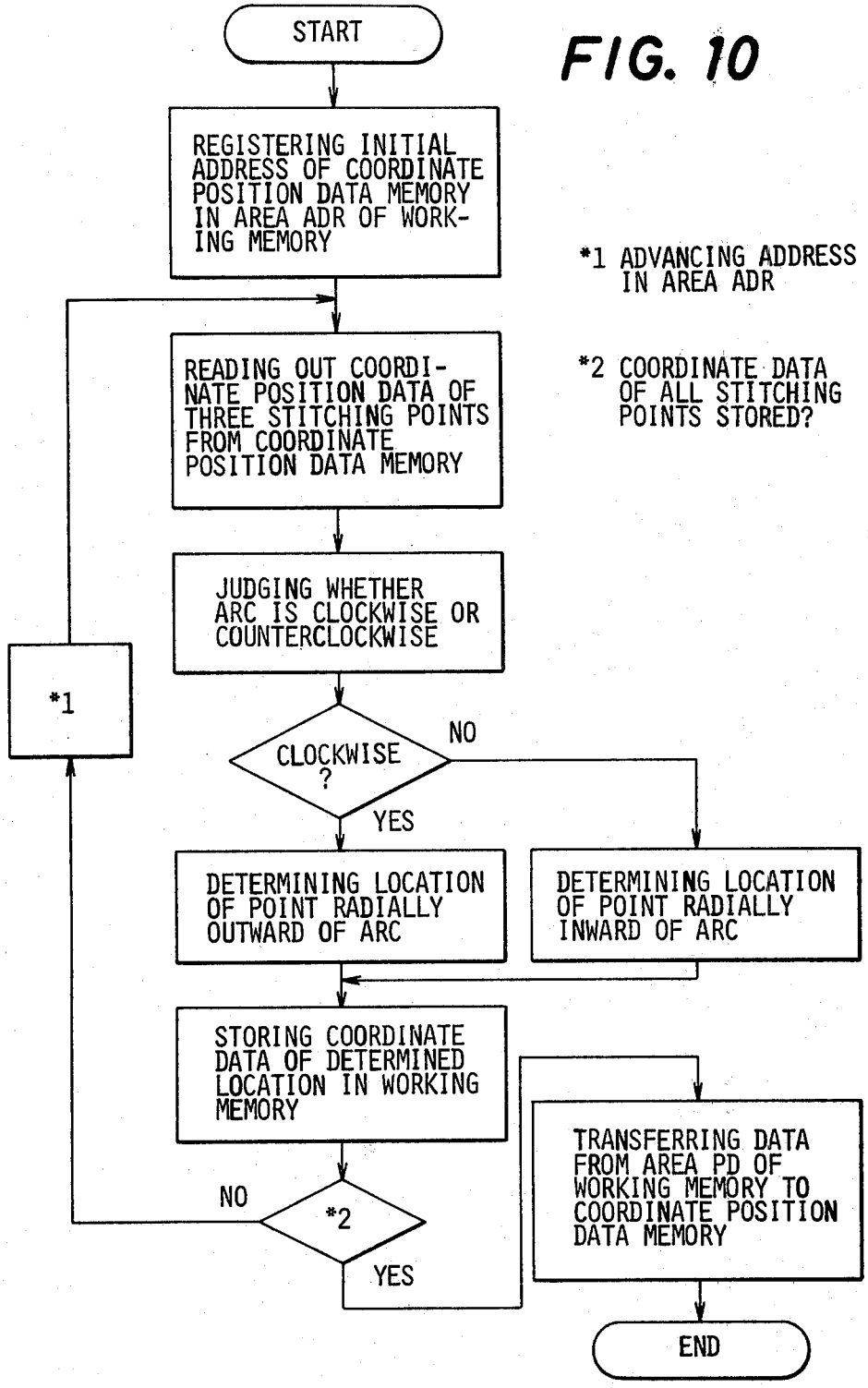

The operation to update the coordinate position data memory 43 is described referring to FIG. 10. Firstly, the control circuit 41 registers, in the memory area ADR of the working memory 42, the initial address of the coordinate position data memory 43, that is, the address at which the coordinate position data of the first stitch point Q1*a* is stored. Then, the circuit 41 reads out from the coordinate position data memory 43 the coordinate position data of the first three consecutive stitching points Q1*a*, Q2*a* and Q3*a*, based on the address now registered in the area ADR of the working memory 42, and obtains a radius R1 and a center C1 of a circular arc which passes the three points Q1*a*, Q2*a* and Q3*a*.

Figure 14:
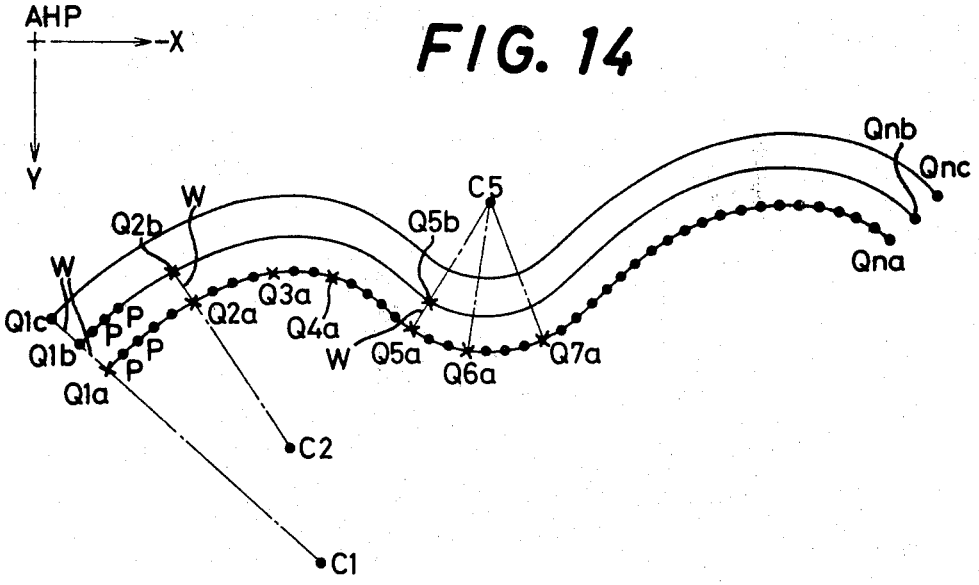

Successively, the control circuit 41 operates to judge whether the circular arc is clockwise or counterclockwise (clockwise when the arc is upwardly convexed and counterclockwise when it is downwardly convexed as seen in FIG. 14 which shows the multi-arc patterns 47*a*, 47*b* and 47*c*). Since the circular arc passing the points Q1*a*, Q2*a* and Q3*a* is clockwise as shown in the figure, the first stitch point Q1*b* of the pattern 47*b* is located on the straight line passing the arc center C1 and the point Q1*a*, so that the point Q1*b* is spaced radially outwardly from the point Q1*a* by a distance W stored in the memory area WIDTH of the working memory 42. The coordinate position data of this stitch point Q1*b* is stored in the memory area PD of the working memory 42.

In the next step, the control circuit 41 advances the address of the coordinate position data memory 43 registered in the area ADR of the working memory in order to read out the coordinate position data of the three consecutive stitching points Q2*a*, Q3*a* and Q4*a*. The circuit 41 then obtains a radius R2 and a center C2 of a circular arc passing these three points Q2*a*, Q3*a* and Q4*a* and judges whether this circular arc is clockwise or counterclockwise. Since the circular arc passing the Q2*a*, Q3*a* and Q4*a* is clockwise similarly to the arc passing the points Q1*a*, Q2*a* and Q3*a*, the stitching point Q2*b* is located on the straight line passing the arc center C2 and the point Q2*a*, so that the point Q2*b* is spaced radially outwardly from the point Q2*a* by the distance W. The coordinate position data of this point Q2*b* is stored in the memory area PD of the working memory 42. The same steps of operations are repeated to locate the following stitching points of the pattern 47*b*.

In this connection, it is noted that the point Q5*b* is located on the straight line passing an arc center C5 and the point Q5*a* so that the point Q5*b* is spaced radially inwardly from the point Q5*a* by the distance W because the circuit 41 recognizes that the circular arc passing the points Q5*a*, Q6*a* and Q7*a* read out from the memory 43 is counterclockwise. The coordinate position data of the point Q5*b* is stored in the memory area PD of the working memory 42.

Thus, the control circuit 41 works out the stitching points Q1*b* through Q*nb* on the curved pattern 47*b* which is apart from the unit stitch pattern 47*a* by the preset distance, and stores the coordinate position data of all of the worked-out points Q1*b*–Qb*n* in the area PD of the working memory 42, and finally transfers the coordinate position data from the area PD into the coordinate position data memory 43.

Successively, the control circuit 41 operates, as shown in FIGS. 8 and 9, to determine the locations of all stitch points P defining the stitch pattern 47*b* in the same manner as used for the pattern 47*a*, based on the coordinate position data of the points Q1*b* through Q*nb* stored in the coordinate position data memory 43, and sequentially prepares the sewing instructions for the individual points P based on the determined locations thereof. The prepared sewing instructions are stored in the sewing instruction memory 44.

After the sewing instructions for all of the stitches to form the curved stitch pattern 47*b* have been stored in the sewing instruction memory 44, the control circuit 41 judges whether the value "1" is present in the memory area NNFL of the working memory 42. Since the value "1" is present there at this time, the circuit 41 then judges whether the value NNN stored in the area NNN of the working memory 42 minus 1 (NNN−1) is 0 (zero) or not. Recognizing that the present NNN value is "2", the control circuit 41 proceeds to subtract a value "1" from the NNN value.

Subsequently, the circuit 41 works out the coordinate position data of the stitching points Q1*c* through Qn*c* on the curved stitch pattern 47*c* which is disposed the predetermined distance W apart from the stitch pattern 47*b*, based on the coordinate position data of the points Q1*b* through Qn*b* stored in the coordinate position data memory 43, and prepares the sewing instructions for all stitches to form the pattern 47*c* based on the obtained data of the points Q1*c*–Qn*c* in the same manner as used to prepare the sewing instructions for the pattern 47*b*. The sewing instructions for the pattern 47*c* are stored in the sewing instruction memory 44.

The control circuit 41 then judges whether the value "1" is present in the area NNFL of the working memory 42, and further judges whether the value (NNN−1) is "0" (zero) or not. Now that the value "1" is present in the area NNN, the circuit 41 recognizes that the value (NNN−1) is zero and therefore clears all memory areas of the working memory 42. Now, the preparation of the sewing instructions for the multiple stitch patterns 47*a*, 47*b* and 47*c* is completed.

In operating the sewing machine from the batch of sewing instructions stored in the sewing instruction memory 44, the work holder is moved so that the curved stitch patterns 47*a*, 47*b* and 47*c* are formed in that order each along a plurality of circular arcs which define the divided portions of each stitch pattern 47*a*, 47*b*, 47*c*, such that those portions are connected with a smooth curvature. As described above, each divided portion of the stitch patterns is substantially defined by a circular arc based on the coordinate position data of three consecutive points. For example, the Q1*a*–Q2*a* portion is defined based on the position data of the points Q1*a*, Q2*a* and Q3*a*, and the Q2*a*–Q3*a* portion based on the position data of the points Q2*a*, Q3*a* and Q4*a*. Thus, the coordinate position data of three points are read out to define a portion between two points whereby the circular arcs defining the divided portions are continuously connected at the stitching points Q2*a* throug Q(n−1)a, Q2*b* through Q(n−1)b, and Q2*c* through Q(n−1)c, allowing a succession of stitches to be formed along a smooth curvature.

Thus, the present invention simplifies the preparation of sewing instructions thereby increasing the programming efficiency. Further, the invention permits formation of very beautifully curved stitch patterns each made up of a succession of stitches located along a plurality of continuous circular arcs.

Although the invention has been described in its preferred form with a certain degree of particularity, it is understood that the present disclosure of the preferred form may be changed in details without departing from the scope of the invention as hereinafter claimed.

What is claimed is:

1. A programming device for an automatic sewing machine, wherein a succession of stitches are formed by relative movements between a needle and a work holder according to a batch of sewing instructions corresponding to a desired profile registered via a pattern record medium, said programming device comprising:

stitch pitch setting means for setting a pitch of said stitches;

reading means for sequentially reading coordinate positions spaced along said profile at an interval longer than said pitch set by said setting means;

first memory means for storing coordinate data of said coordinate positions read by said reading means;

first control means for sequentially reading out said coordinate data from said first memory means such that the coordinate data of three consecutive ones of said coordinate positions are always available;

second control means for preparing a series of sewing instructions to form the stitches which are located on a circular arc passing the three consecutive coordinate positions defined by said coordinate data thereof and equally spaced at the pitch set by said setting means; and second memory means for storing said sewing instructions prepared by said second control means.

2. A programming device according to claim 1, wherein said second control means prepares said series of sewing instructions to form the stitches which are equally spaced along a portion of said circular arc between a first two of said three consecutive coordinate positions.

3. A programming device for an automatic sewing machine wherein a succession of stitches defining an original line of stitch pattern are formed by relative movements between a needle and a work holder according to a batch of sewing instructions corresponding to a desired profile registered via a pattern record medium, said programming device comprising:

stitch pitch setting means for setting a pitch of said stitches;

reading means for sequentially reading coordinate positions spaced along said profile at an interval longer than said pitch set by said setting means;

first memory means for storing, as a first group of coordinate data, the data of said coordinate positions read by said reading means;

interval setting means for setting an interval of spacing at least one additional line of stitch pattern which is disposed in parallel to said original line of stitch pattern defined by said first group of coordinate data;

first control means for preparing at least one other group of coordinate data defining coordinate positions on said additional line of stitch pattern, said first control means causing to store said at least one other group of coordinate data in said first memory means;

second control means for sequentially reading out, from each of said first and at least one other groups of coordinate data, said coordinate data such that the data of three consecutive ones of said coordinate positions are always available;

third control means for preparing a series of sewing instructions to form the stitches which are located on a circular arc passing the three consecutive coordinate positions defined by said coordinate data thereof of each of said first and at least one other groups and which are equally spaced at the pitch set by said setting means; and second memory means for storing said sewing instructions prepared by said third control means.

4. A programming device according to claim 3, wherein said first control means includes:

means for sequentially reading out, from said first memory means, said first group of coordinate data such that the data of three consecutive ones of said coordinate positions are always available; and means for preparing said at least one other group of coordinate data based on said coordinate data of said three consecutive positions and on said interval of spacing set by said interval setting means.

5. A programming device according to claim 3, wherein said at least one additional line of stitch pattern is plural in number, and said first control means repeats to prepare said coordinate data to define coordinate positions on the plural number of additional lines of stitch pattern.

6. A programming device according to claim 5, which further comprises means for setting the number of said additional lines of stitch pattern.

7. A programming device according to claim 3, wherein said third control means prepares said series of sewing instructions to form the stitches which are equally spaced along a portion of said circular arc between a first two of said three consecutive coordinate positions on each of said original and additional lines of stitch pattern.

* * * * *